United States Patent [19]

Machacek

[11] 4,115,165

[45] Sep. 19, 1978

[54] HYDROPHOBIC ALUMINUM SENSITIZING AGENTS FOR EXPLOSIVES

[75] Inventor: Oldrich Machacek, Allentown, Pa.

[73] Assignee: Atlas Powder Company, Tamaqua, Pa.

[21] Appl. No.: 809,203

[22] Filed: Jun. 23, 1977

[51] Int. Cl.[2] ..... C06B 45/30

[52] U.S. Cl. ..... 149/5; 149/41; 149/42; 149/43; 149/44; 149/114

[58] Field of Search ..... 149/5, 114, 41, 42, 149/43, 44

[56] References Cited

U.S. PATENT DOCUMENTS 2,407,151 9/1946 Glogaw ..... 149/5

*Primary Examiner*—Stephen J. Lechert, Jr.

*Attorney, Agent, or Firm*—Richards, Harris & Medlock

[57] ABSTRACT

A sensitizing agent for explosive compositions is provided which comprises particulate aluminum coated with a finely divided hydrophobic fumed silica. Upon incorporation of the hydrophobic material coated aluminum into an aqueous gel explosive composition, relatively large air bubbles, as compared to the size of the individual particles of aluminum, form adjacent the surface of the aluminum. The resulting sensitizing complex includes a relatively large air bubble in close proximity to particulate aluminum, thereby providing a combination which imparts greater sensitivity to the explosive composition.

14 Claims, No Drawings

HYDROPHOBIC ALUMINUM SENSITIZING AGENTS FOR EXPLOSIVES

BACKGROUND OF THE INVENTION

In one aspect the present invention relates to a sensitizing agent for explosive compositions which comprises coarse grade particulate aluminum coated with a finely divided hydrophobic fumed silica material. In another aspect, the subject invention relates to a process for producing a sensitizing complex useful in aqueous gel explosive compositions which comprises a relatively large air bubble attached to a particle of coarse grade particulate aluminum. In still a further aspect, the invention of the subject application relates to novel aqueous gel explosive compositions sensitized with coarse grade particulate aluminum coated with a finely divided hydrophobic fumed silica material.

Particulate aluminum has been used as an additive in conventional explosive compositions to a large extent in either coarse particulate form or in a finer particulate form known within the industry as "paint grade" aluminum. Compared to the large surface area per unit weight of paint grade aluminum (generally in the range of from 3 to about 10 square meters per gram) coarse grade aluminum, which typically includes atomized aluminum, for example, has a relatively small surface area per unit weight. For example, atomized aluminum normally has surface areas ranging from about 0.05 to about 1 meters square per gram.

Coarse grade particulate aluminum, such as atomized aluminum for example, has conventionally been used in explosive compositions in amounts in the range of from about 5 to 20% by weight of the explosive composition for the purpose of increasing the explosive energy of the compositions by providing a readily oxidizable fuel. On the other hand, relatively fine particulate aluminum, such as paint grade aluminum coated with stearic acid is recognized to impart a significant sensitizing effect in water gel explosive compositions. For example it is known that aqueous gel explosive compositions which are difficult to detonate, or are nondetonatable, can be made cap sensitive by adding paint grade aluminum in amounts ranging from about 2 to 5% by weight of the explosive composition. One accepted theory explaining the differences in effect on explosive compositions which occur when paint grade aluminum is employed as opposed to atomized aluminum, for example, is that the greater surface area of paint grade aluminum, when coated with stearic acid, allows a thin layer of air to be absorbed or carried thereon thus providing an air-aluminum combination which is very effective as a sensitizing agent. Coarser grades of aluminum such as atomized aluminum do not have surface areas as large, on the average, as those of paint grade aluminum. For example paint grade aluminum, which is always coated with a thin layer of stearic acid, may have surface areas in the range of from 3 to about 10 sq. m/g. In contrast, the surface area of atomized aluminum is usually in the range of only about 0.1 to about 0.3 sq. m/g.

Thus particulate aluminum in two distinct forms has been used in explosive compositions to obtain two different desirable properties. Very fine particulate aluminum, such as paint grade aluminum, has been employed as a sensitizing agent either alone or in conjunction with other chemical sensitizers such as perchlorates and amine nitrates. Coarser grades of particulate aluminum, such as atomized aluminum, have been added in order to increase the power of explosives by providing a high energy fuel source.

As noted above, paint grade aluminum is coated with stearic acid in order to provide a hydrophobic surface which will hold or absorb air, in a thick gelled medium, so as to provide the aluminum-air complex necessary for sensitization. However, the sensitizing effect of coarse aluminum is very small even if the surface contains a coating of hydrophobic stearic acid. Apparently this is because the amount of air absorbed is dependent upon the surface area of the aluminum and therefore the absorbed air is relatively small because of the relatively small surface area of coarse grade aluminum.

While paint grade aluminum does provide an effective sensitizing agent in many cases it is relatively expensive as compared to other sensitizing agents and, because of its very fine particle size, presents handling difficulties when employed in large scale explosive manufacturing processes. Therefore, a relatively inexpensive, easier to handle aluminum sensitizing agent is desirable.

SUMMARY OF THE INVENTION

According to the present invention, it has been discovered that aqueous gel explosive compositions may be sensitized by employing coarse grade particulate aluminum which has been coated with a finely divided hydrophobic fumed silica. In a preferred embodiment of the subject invention it has been discovered that by admixing coarse grade aluminum, such as atomized aluminum, with a finely divided hydrophobic silica material, a sensitizing agent is produced which, upon admixture with an aqueous gel explosive composition, produces a sensitizing complex of relatively large air bubbles attached to particles of atomized aluminum.

Generally, the sensitizing agent of the subject invention can be prepared by admixing the finely divided hydrophobic fumed silica with coarse particulate aluminum in an amount of from about 1 to about 10% by weight of the aluminum. A preferred range of hydrophobic material is from about 3 to about 5% by weight of the coarse particulate aluminum. Coarse particulate aluminum admixed in the stated proportions with finely divided hydrophobic fumed silica materials can then be used to sensitize aqueous gel explosive compositions. Such a sensitizing agent can be used either alone or in conjunction with additional chemical sensitizers such as paint grade aluminum, methylamine nitrate, ethylenediamine dinitrate, ethanolamine nitrate, hexamethylenetetramine nitrate, and combinations thereof, for example.

DETAILED DESCRIPTION

The use of air, or other gas bubbles to sensitize aqueous gel explosive compositions is well known in the explosive arts. Further, the use of paint grade aluminum, which has a relatively large surface area, as a sensitizing agent in aqueous based explosive compositions is also known. The paint grade aluminum is coated with stearic acid which provides for the absorption of air onto the surface of the aluminum particles. This combination of air, in close association with aluminum which is a fuel, provides an efficient sensitizing effect which can produce desirable detonation characteristics in otherwise hard to detonate aqueous based explosive compositions. Because coarser grades of aluminum such as atomized aluminum for example, do not have a large a surface area as does paint grade aluminum, the sensitizing effect of adding coarser graded aluminum to aqueous based explosive compositions is minimal even if a stearic acid coating is employed. However, the use of coarse grade aluminum as a fuel component in explosives is widely accepted. Thus, it is not unusual for an aqueous based explosive composition to contain both coarse grade aluminum, as a fuel component thereof, and paint grade aluminum, which is added for the purpose of sensitizing the composition.

An object of the present invention is to provide an air-aluminum complex suitable for sensitizing aqueous based explosive compositions and which utilizes coarse grade particulate aluminum in place of the more expensive and harder to handle paint grade aluminum. Basically, it has been discovered that by admixing coarse grade aluminum with a finely divided hydrophobic fumed silica material the resultant coarse grade aluminum will attract and become attached to air bubbles present in an aqueous gel explosive composition upon admixture therewith. The result is a highly desirable sensitizing complex comprising an air bubble affixed or adjacent to particulate aluminum. This complex behaves, in the gel explosive composition, analogously to flotation agents which are used in various other industrial applications. While the exact theory by which such a sensitization complex operates is not known it is possible that upon detonation the air bubble undergoes collapsion and adiabatic compression, thereby forming a "hot spot" which, because of its close proximity to the aluminum fuel, creates sufficient energy to detonate the oxidizer and fuel components of the aqueous explosive composition. It should be noted that while normally air will be the gaseous component, other gases, such as nitrogen for example, could also be used to form the gas-aluminum complex.

Generally, the coarse grade particulate aluminum which can be used together with finely divided hydrophobic fumed silica materials to produce an aluminum sensitizing agent according to the subject invention has a surface area per unit weight of from about 0.05 to about 1.0 sq. m/g. The preferred form of coarse grade particulate aluminum is atomized aluminum which is generally spherical and is available commercially in surface areas ranging from about 0.1 to about 1.0 sq. m/g. Atomized aluminum normally has particle sizes in the 25–30 micron range.

The finely divided hydrophobic fumed silica materials employed by the subject invention are in powdered form and are manufactured using flame hydrolysis techniques. These materials are a very pure form of silicon dioxide aerosol and are very hydrophobic. In particular, a hydrophobic silica material produced by the reaction of silicon dioxide aerosol (obtained by flame hydrolysis) with chlorosilanes, is preferred. The silica content of such materials normally exceeds 99.8%. These finely divided hydrophobic silica materials generally have particle sizes in the range of from about 5 to about 40 millimicrons and have a surface area in the range of about 90 to about 300 sq. m/g. A suitable such hydrophobic finely divided silica material is sold under the trade designation AEROSIL R 972 by Degussa, Inc., Pigments Division, Kearny, New Jersey. Another suitable hydrophobic silica material is sold under the tradename TULLANOX 500, by Tulco Corporation, North Billerica, Massachusetts.

The aluminum sensitizing agents of the present invention can be produced by admixing coarse grade particulate aluminum with an effective amount of the finely divided hydrophobic fumed silica material. For example, from about 1 to about 10% by weight of the finely divided hydrophobic fumed silica (based on the weight of the aluminum being employed) can be admixed with the coarse grade particulate aluminum and when this mixture is added to a water gel explosive composition it is found to have a significant sensitizing effect. A preferred range of finely divided hydrophobic fumed silica material is from about 3 to about 5% by weight of the coarse grade aluminum.

The above described mixture of coarse grade aluminum and finely divided hydrophobic fumed silica material can be added in a conventional manner to water base explosives. The sensitizing agent of the present invention has been discovered to be especially useful in gelled explosive compositions which contain inorganic oxidizing salts, water, fuels, thickening agents and sensitizers. The sensitizing agent of the present invention can be used either alone or in conjunction with other sensitizing agents conventionally employed in aqueous gel explosive compositions such as paint grade aluminum, monomethylamine nitrate, monoethanolamine nitrate, ethylenediamine dinitrate, and hexamethylenetetramine nitrate, for example. Cross-linking agents are usually employed in these gel explosive compositions in order to control the viscosity and degree of gelation of the aqueous phase, and to improve water resistance.

Aqueous gel explosive compositions containing the sensitizing agent of the present invention can be prepared in the following manner. First, the inorganic oxidizing salts are admixed with water at elevated temperatures to obtain an inorganic oxidizing salt solution. Preferred inorganic oxidizing salts include ammonium nitrate and sodium perchlorate, however a variety of conventional inorganic oxidizing salts such as the alkali or alkaline earth metal nitrates, other inorganic perchlorates and the like can be employed. Sensitizing agents such as methylamine nitrate, ethylenediamine dinitrate, ethanolamine nitrate, hexamethylenetetramine nitrate and the like can be admixed with the oxidizer solution. Liquid and solid fuels such as ethylene glycol and urea are employed by admixing these components with the aqueous solution of oxidizing salts. A suitable thickener such as guar gum and, if desired, a cross-linking agent are then introduced by mixing in order to thicken the aqueous solution. In addition, pH adjusting agents can be added if desired.

The coarse grade aluminum is premixed with the hydrophobic silica material in a conventional manner to thereby substantially coat the aluminum with fine particles of the silica material. In addition, dusting or non-dusting type paint grade aluminum may be admixed with the coarse grade aluminum-hydrophobic silica premix, if desired. This premix is then incorporated into the thickened aqueous solution by conventional agitation means, thereby causing the formation of the air-aluminum sensitizing complex within the explosive gel.

Microscopic analysis of compositions prepared in this manner reveals that the air bubbles present in the aqueous gel tend to migrate to and become attached to the coarse grade aluminum-hydrophobic material particles of the sensitizing agent of the present invention. On the average, such air bubbles are relatively large in comparison to the particle size of the coarse grade aluminum. For example, when atomized aluminum coated with hydrophobic fumed silica is employed the particle size of the aluminum-hydrophobic silica complex, depending upon the particle size of the aluminum, can be approximately 50 microns. The air bubbles which are attracted by the hydrophobic silica have been observed to be approximately 300 microns, on the average. This air-aluminum complex is highly analogous to complexes formed in industrial flotation techniques where relatively large air bubbles attach to small particles. Thus, upon admixture of the coarse grade aluminum-hydrophobic silica sensitizing agent of the present invention with an aqueous gel explosive composition, which has been aerated by the introduction of air bubbles, a highly effective sensitizing complex comprising air bubbles affixed or adjacent the aluminum-hydrophobic silica sensitizing agent is produced. These sensitizing complexes have been found to greatly improve the sensitivity of the aqueous gel explosive compositions in which they are contained. In addition, gel explosives employing the sensitizer of the present invention have good storage characteristics. It is believed that this is due, in part, to the fact that the finely divided hydrophobic fumed silica coating retards reactions between the aluminum and the oxidizing solution during storage.

EXAMPLES

The following examples are presented in order to better facilitate the understanding of the subject invention but are not intended to limit the scope thereof.

EXAMPLE 1

The following materials were employed to produce an aqueous gel explosive composition suitable for packaging in cartridge form:

65.0 parts Ammonium Nitrate
6.5 parts Sodium Perchlorate
12.6 parts Water
5.1 parts Ethylene Glycol
0.8 parts Guar Gum (EXFC-50, which contains 6% by weight of a cross-linking agent, Celanese Corp., Louisville, Ky.)
10.0 parts Atomized Aluminum (Alcoa 1641G, Alcoa Aluminum, Pittsburgh, Pa.)
0.33 parts Finely Divided Hydrophobic Silica (Aerosil R972)

Initially, 30 lbs. of the ammonium nitrate and all of the sodium perchlorate were dissolved in water at approximately 130° F with agitation to obtain a clear solution. The remaining amount of ammonium nitrate (35 lbs.) was then added in a ground form. The guar gum, premixed with the ethylene glycol, was then added to this oxidizing salt solution. Upon thickening of the aqueous solution, slight aeration was introduced by agitation, in order to reduce the density of the composition to approximately 1.37 g/cc. Finally the atomized aluminum which had been premixed with the hydrophobic silica was incorporated into the mixture.

The resulting explosive gel composition had a density of 1.27 g/cc and was found to be detonatable in a 2 inch diameter cartridge with an Atlaprime primer (sold by Atlas Powder Co., Tamaqua, Pa.) which contains approximately 2 g PETN. Detonation velocity was 9,250 ft/sec.

EXAMPLE 2

The following materials were combined to produce an aqueous gel explosive composition suitable for packaging in cartridges:

36.5 parts Ammonium Nitrate Flake
5.5 parts Sodium Perchlorate
14.6 parts Water
0.1 parts Monoammonium Phosphate/Diammonium Phosphate 1:1, (pH buffer)
30.0 parts Ammonium Nitrate Prills
2.0 parts Ethylene Glycol
0.8 parts Guar Gum (EXFC-50)
10.0 parts Atomized Aluminum (Alcoa 1401)
0.4 parts Finely Divided Hydrophobic Silica (Aerosil R972)

The ammonium nitrate flake, sodium perchlorate and pH buffer were dissolved in the water at approximately 120° F. The ammonium nitrate prills were then added and the oxidizer solution was thickened by addition of the guar gum dispersed in the ethylene glycol. The resulting thickened aqueous solution was then aerated to a density of approximately 1.29 g/cc. The atomized aluminum which had been premixed with the hydrophobic silica was then incorporated into the mix.

The resulting aqueous gel explosive composition had a density of 1.24 g/cc and was found to be detonatable in cartridge diameters of 1¼ inch with either an Atlaprime primer or a conventional No. 6 blasting cap. Detonation velocity was 11,490 ft/sec. in both cases.

EXAMPLE 3

An aqueous gel explosive composition suitable for packaging in cartridges was prepared using the following materials:

30.0 parts Ammonium Nitrate Flake
3.0 parts Sodium Perchlorate
8.0 parts Monomethylamine Nitrate
0.2 parts Monoammonium Phosphate/Diammonium Phosphate, (pH buffer)
16.0 parts Water p0 31.6 parts Ammonium Nitrate Prills
0.8 parts Guar Gum (EXFC-50)
10.0 parts Atomized Aluminum (Alcoa 1620A)
0.4 parts Finely Divided Hydrophobic Silica (Aerosil R972)

The above materials were combined in the same manner as set forth in EXAMPLE 2. The resulting aqueous gel explosive composition had a density of 1.21 g/cc and it was found to be detonatable to a 1¼ inch diameter cartridge with an Atlaprime primer. Detonation velocity was 8,770 ft/sec.

EXAMPLE 4

The following materials were combined to form an explosive gel composition capable of being pumped for purposes of placement at the site of use:

51.8 parts Ammonium Nitrate Flake
3.0 parts Sodium Perchlorate
5.0 parts Sodium Nitrate
0.1 parts Monoammonium Phosphate/Diammonium Phosphate 1:1, (pH buffer)
25.0 parts Water
4.0 parts Ethylene Glycol
0.7 parts Guar Gum (Jaguar NG, Celanese Corp., Louisville, Ky.)
0.01 parts Potassium Pyroantimonate (Cross-linker)
10.0 parts Atomized Aluminum (Alcoa 1620A)
0.4 parts Finely Divided Hydrophobic Silica (Aerosi R972)

The ammonium nitrate, sodium nitrate, sodium per chlorate and pH buffer materials were dissolved in the water at approximately 100° F. The guar gum and cross-linker were then dispersed in the ethylene glyco and this solution was added to the oxidizer salt solution Upon thickening, the atomized aluminum, which had been premixed with the hydrophobic silica, was incorporated into the gel.

The resulting aqueous gel explosive composition had a density of 1.26 g/cc and was found to be detonatable in 2 inch diameters with an Atlaprime primer. Detonation velocity was 10,200 ft/sec.

EXAMPLE 5

A second pumpable aqueous gel explosive composition was prepared from the following materials:

54.8 parts Ammonium Nitrate Flake
3.0 parts Sodium Perchlorate
6.0 parts Urea
25.0 parts Water
0.1 parts Monoammonium Phosphate
0.01 parts Cross-linker
10.0 parts Atomized Aluminum (Alcoa 1620A)
0.4 parts Hydrophobic Silica (Aerosil R972)
0.02 parts Sodium Dichromate
0.7 parts Guar Gum (Jaguar NG)

The ammonium nitrate, sodium perchlorate, urea and monoammonium phosphate were dissolved in the water using a conventional mixer in order to obtain a clear solution. The cross-linker and guar gum were then added to the solution. Atomized aluminum, having been premixed with the hydrophobic silica, was then incorporated into the mix. Sodium dichromate was then dissolved in a small amount of water and added to the mix.

The resulting aqueous gel explosive composition had a density of 1.28 g/cc and was found to be detonatable in 2 inch diameters with an Atlaprime. Detonation velocity was 10,410 ft/sec.

EXAMPLE 6

A pourable aqueous gel explosive composition was prepared from the following materials:

50.0 parts Ammonium Nitrate
7.0 parts Sodium Nitrate
3.5 parts Sodium Perchlorate
7.0 parts Urea
21.45 parts Water
0.1 parts Monoammonium Phosphate/Diammonium Phosphate 1:1, (pH buffer)
0.0055 parts Potassium Antimony Tartrate (Cross-linking agent)
0.011 parts Sodium Dichromate (Cross-linker)
0.55 parts Guar Gum
10.0 parts Atomized Aluminum (Alcoa 1620A)
0.4 parts Hydrophobic Silica (Aerosil R972)

The ammonium nitrate, sodium nitrate, sodium perchlorate, urea, pH buffer, and cross-linker were dissolved in water at approximately 90° F. The guar gum was then added to this aqueous solution. The atomized aluminum was premixed with the hydrophobic silica and this mixture was then incorporated into the thickened aqueous solution. Sodium dichromate was then added as a 2% aqueous solution.

The final density of the resultant aqueous explosive gel composition was 1.36 g/cc. The viscosity, after 24 hrs. of storage, was approximately 10,000 cp and the explosive composition demonstrated excellent pouring characteristics. The aqueous gel explosive composition was found to be detonatable in a 2⅞ inch diameter with a 1 lb. cast primer, and had a detonation velocity of 13,160 ft/sec.

EXAMPLE 7

An aqueous gel explosive composition suitable for packaging in cartridges was prepared using the following materials:

30.0 parts Ammonium Nitrate Flake
10.0 parts Sodium Nitrate
16.0 parts Monomethylamine Nitrate
18.0 parts Water
0.1 parts Monoammonium Phosphate/Diammonium Phosphate 1:1, (pH buffer)
16.8 parts Ammonium Nitrate Prills
0.175 parts Guar Gum (EXFC-50)
8.0 parts Atomized Aluminum (Alcoa 1401)
0.35 parts Hydrophobic Silica (Aerosil R972)

The above materials were combined in a manner similar to that set forth in EXAMPLE 6 and the resultant aqueous gel explosive composition was found to have a density of 1.23 g/cc. Further, the explosive composition was found to be detonatable in diameters of 1¼ inch with a No. 6 cap.

EXAMPLE 8

Another aqueous gel explosive composition suitable for packaging in cartridges was prepared using the following materials:

3.0 parts Ammonium Nitrate Flake
3.0 parts Sodium Perchlorate
14.6 parts Water
0.1 parts Monoammonium Phosphate/Diammonium Phosphate (pH buffer)
40.2 parts Ammonium Nitrate, Ground
0.8 parts Guar Gum (Jaguar NG, Celanese Corp., Louisville, Ky.)
8.0 parts Atomized Aluminum (Reynolds 400)
0.3 parts Finely Divided Dydrophobic Silica (Aerosil R972)
3.0 parts Paint Grade Aluminum (Alcoa 1663, non-dusting)
0.016 parts Potassium Pyroantimonate The above materials were combined in a manner similar to that set forth in Example 6. The resulting explosive composition was found to be detonatable in a 1¼ inch diameter cartridge with a No. 6 cap at 0° F.

EXAMPLE 6

A pumpable gel explosive composition which was cross-linked at the end of a loading hose was prepared from the following materials:

67.0 parts Ammonium Nitrate Flake
18.0 parts Water
1.0 parts Guar Gum (Jaguar NG, Celanese)
13.7 parts Atomized Aluminum (Alcoa 1620A)
0.3 parts Hydrophobic Silica (Aerosil R972)
1.0 parts 10% Solution of Liquid Cross-linker in Water (DW-3, Celanese)

The explosive composition of this example was prepared by dissolving ammonium nitrate in the water at 150° F with agitation. pH was then adjusted to 4.3 by addition of the proper amount of glacial acetic acid. The guar gum was then added to thicken the aqueous solution and the aluminum, premixed with the hydrophobic silica, was added to the thickened, but not cross-linked aqueous solution. The thickened aqueous solution was then pumped through the loading hose and admixed at the outlet thereof with the 10% solution of liquid cross-linker in ratios of 1 part cross-linker solution to 100 parts thickened aqueous gel. The resulting explosive composition was found to be detonatable in a 5 inch diameter with a 1 lb. cast primer after 48 hrs. of storage. The explosive composition had a detonation velocity of 15,150 ft./sec.

While this invention has been described in relation to its preferred embodiments, it is to be understood that various modifications thereof will be apparent to those of ordinary skill in the art upon reading the specification and it is intended to cover all such modifications as fall within the scope of the appended claims.

I claim:

1. A sensitizing agent for explosive compositions comprising coarse grade particulate aluminum substantially coated with finely divided hydrophobic fumed silica.

2. The sensitizing agent of claim 1 wherein said hydrophobic fumed silica is present in an amount of from about 1 to about 10% by weight of said coarse grade particulate aluminum.

3. The sensitizing agent of claim 2 wherein said coarse grade aluminum has a surface area of from about 0.05 to about 1.0 square meters per gram.

4. The sensitizing agent of claim 3 wherein said coarse grade aluminum is atomized aluminum.

5. The sensitizing agent of claim 2 wherein said finely divided hydrophobic silica material has a particle size of from about 5 to about 40 millimicrons.

6. The sensitizing agent of claim 5 wherein said hydrophobic silica has a surface area of from about 90 to 300 square meters per gram.

7. In an aqueous based gel explosive composition, the improvement comprising, sensitizing said composition by incorporating therein an effective amount of coarse grade particulate aluminum coated with finely divided hydrophobic fumed silica.

8. The improved aqueous gel explosive composition of claim 7 wherein said coarse grade particulate aluminum is atomized aluminum having a surface area of from about 0.05 to about 1.0 square meters per gram.

9. The improved aqueous based explosive composition of claim 8 wherein said coarse grade particulate aluminum is coated with from about 1 to about 10 percent of the hydrophobic fumed silica material, based on the weight of the coarse grade particulate aluminum.

10. A process for producing a sensitizing agent for use in an aqueous gel explosive composition comprising admixing coarse grade particulate aluminum with an effective amount of a finely divided hydrophobic fumed silica material to thereby substantially coat said aluminum with said silica material.

11. The process of claim 10 wherein said hydrophobic material has a particle size of from about 5 to about 40 millimicrons and a surface area of from about 90 to about 300 square meters per gram.

12. The process of claim 11 wherein said hydrophobic material is a present in an amount equal to from about 1 to about 10 percent by weight of coarse grade particulate aluminum.

13. An aqueous gel explosive composition comprising inorganic oxidizing salts, fuels, water, thickening agents, and coarse grade particulate aluminum coated with finely divided fumed hydrophobic silica.

14. The gel explosive composition of claim 13 and further comprising additional sensitizing agents selected from the group consisting of paint grade aluminum, monomethylamine nitrate, ethylenediamine dinitrate, ethanolamine nitrate, and hexamethylenetetramine nitrate.

* * * * *

UNITED STATES PATENT AND TRADEMARK OFFICE

CERTIFICATE OF CORRECTION

PATENT NO. : 4,115,165

DATED : September 19, 1978

INVENTOR(S) : Oldrich Machacek

It is certified that error appears in the above-identified patent and that said Letters Patent are hereby corrected as shown below:

Column 6, line 34, change "16.0 parts Water p031.6 parts Ammonium Nitrate Prills" to (two separate lines) --16.0 parts Water
31.6 parts Ammonium Nitrate Prills--;
line 42, change "to" (second occurrence) to --in--.

Column 8, line 36 change "Dydrophobic" to --Hydrophobic--;
line 46 change "EXAMPLE 6" to --EXAMPLE 9--.

Column 9, line 2, change "diameter with" to --diameter cartridge with--.

Column 10, line 23, after "is" delete "a".

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*